US009482493B2

(12) United States Patent
Arrighi et al.

(10) Patent No.: US 9,482,493 B2
(45) Date of Patent: Nov. 1, 2016

(54) TURRET STRUCTURE, IN PARTICULAR FOR A FIGHTING VEHICLE

(71) Applicant: OTO MELARA S.P.A., La Spezia (IT)

(72) Inventors: Paolo Arrighi, La Spezia (IT); Lorenzo Moroni, La Spezia (IT)

(73) Assignee: OTO MELARA SPA, La Spezia (IT)

( * ) Notice: Subject to any disclaimer, the term of this patent is extended or adjusted under 35 U.S.C. 154(b) by 0 days.

(21) Appl. No.: 14/904,020

(22) PCT Filed: Jul. 1, 2014

(86) PCT No.: PCT/IB2014/062753
§ 371 (c)(1),
(2) Date: Jan. 8, 2016

(87) PCT Pub. No.: WO2015/004568
PCT Pub. Date: Jan. 15, 2015

(65) Prior Publication Data

US 2016/0169634 A1 Jun. 16, 2016

(30) Foreign Application Priority Data

Jul. 10, 2013 (IT) ..... TO2013A0580

(51) Int. Cl.
*F41H 5/20* (2006.01)
*F41H 5/013* (2006.01)

(52) U.S. Cl.
CPC ..... *F41H 5/20* (2013.01); *F41H 5/013* (2013.01)

(58) Field of Classification Search
USPC ..... 89/36.13, 36.07, 36.08, 36.09
See application file for complete search history.

(56) References Cited

U.S. PATENT DOCUMENTS

| | | | | |
|---|---|---|---|---|
| 6,701,821 | B2 * | 3/2004 | Lundqvist | F41A 9/56 89/37.01 |
| 7,942,092 | B1 * | 5/2011 | Kiel | F41H 5/16 89/36.08 |
| 8,356,541 | B2 * | 1/2013 | Schneider | F41H 5/013 89/36.08 |
| 9,146,081 | B2 * | 9/2015 | Chu | F41H 5/013 |
| 2012/0183716 | A1 * | 7/2012 | Jordan | B29C 70/088 428/47 |

FOREIGN PATENT DOCUMENTS

| | | | |
|---|---|---|---|
| EP | 0122187 | A1 | 10/1984 |
| EP | 1605223 | A1 | 12/2005 |
| FR | 787650 | A | 9/1935 |
| WO | 2010/150197 | A1 | 12/2010 |

OTHER PUBLICATIONS

International Search Report and Written Opinion for corresponding International Patent Application No. PCT/IB2014/062753, mailed Oct. 17, 2014.
International Preliminary Report on Patentability for corresponding International Patent Application No. PCT/IB2014/062753, mailed Oct. 14, 2015.
Paolo Valpolini: "Turrets on a Leash", Armada International, Armada International, Zurich, CH, vol. 36, No. 6, Dec. 1, 2012, pp. 6-13, XP001579941.

* cited by examiner

*Primary Examiner* — J. Woodrow Eldred
(74) *Attorney, Agent, or Firm* — Merchant & Gould P.C.

(57) ABSTRACT

A turret includes a hollow casing provided with a gun, such as a cannon. The casing includes an upper half-shell at least partially widening towards the bottom of the casing, and a lower half-shell at least partially widening towards the top of the casing; the upper half-shell and the lower half-shell meeting and widening, in at least one edge border of the casing.

4 Claims, 4 Drawing Sheets

TURRET STRUCTURE, IN PARTICULAR FOR A FIGHTING VEHICLE

This application is a National Stage Application of International Patent Application No. PCT/IB2014/062753, filed 1 Jul. 2014, which claims benefit of Serial No. TO2013A000580, filed 10 Jul. 2013 in Italy and which applications are incorporated herein by reference. To the extent appropriate, a claim of priority is made to each of the above disclosed applications.

TECHNICAL FIELD

The present invention relates to a turret, in particular for a fighting vehicle.

TECHNOLOGICAL BACKGROUND

In the technical field turrets are known, i.e. systems that are generally adapted for supporting a firearm and are able to protect the men on board or the mechanism that allows the projectile associated with the firearm to be shot, allowing at the same time the firearm to be aimed and to shoot in different directions.

Turrets are typically designed to be installed not only on buildings or fixed structures, but also on mobile structures, such as military aircraft, fighting vehicles, etc.

In the art are known some devices as described in their respective documents.

For example, EP 0122187 A1 discloses a turret for an armored vehicle comprising a saddle mounted on the vehicle via a ring race allowing its rotation around a vertical axis and an oscillating body mounted on the saddle via trunnions so as to be able to oscillate around a horizontal axis, the saddle being made up of a baseplate and front, rear and side walls and covered by the oscillating body, wherein the baseplate of the saddle is located approximately in the plane of the ring race, the front and rear walls of the saddle are made up of sections of cylindrical surfaces the axes of which coincide with the axes of the trunnions and delimit with the side walls in the plane of the baseplate a polygon circumscribed about the circular opening of the baseplate bordered by the ring race, and the oscillating body has, seen from the side, the shape of two trapezes joined by their long bases, its side walls consisting of inclined panels assembled to form protruding edge dihedrons.

Though, turrets manufactured according to the prior art suffer from some drawbacks.

SUMMARY OF THE INVENTION

An object of the present invention is to provide a turret, which is able to solve the drawbacks of the prior art and which, at the same time, can be produced in a simple and economic fashion. In particular, an object of the present invention is to provide a turret provided with an improved casing, which is adapted for ensuring a particularly effective ballistic protection.

According to the present invention, this and other objects are reached by means of a turret described herein.

The appended claims are an integral part of the technical teachings provided in the following detailed description concerning the present invention.

BRIEF DESCRIPTION OF THE DRAWINGS

Further features and advantages of the present invention will be best understood upon perusal of the following detailed description, which is provided by way of example and is not limiting, with reference, in particular, to the accompanying drawings, wherein.

DETAILED DESCRIPTION OF THE INVENTION

With reference to the accompanying drawings, number 10 indicates, as a whole, a turret, in particular for a fighting vehicle, manufactured according to an explanatory embodiment of the present invention.

In particular, turret 10 is designed to be mounted on top of a fighting vehicle, for example on a tank (not shown). More in detail, turret 10 is mounted so as to rotate relative to the fighting vehicle, so that it is able to rotate around a substantially vertical axis, moving on a substantially horizontal plane.

Though, in further embodiments, turret 10 can be mounted not only on a fighting vehicle, but also on buildings and fixed structures, as well as on mobile structures, for example military aircraft.

Turret 10 has a hollow casing 12, which is provided with a firearm, such as a cannon 14. In the embodiment shown, cannon 14 projects towards the outside of hollow casing 12 and is supported by the latter during its rotation around a substantially horizontal axis As described more in detail below, hollow casing 12 is provided, on the outside, with an armor, which is designed to protect the hollow casing itself from the impact and the explosion of the ammunitions coming from enemy weapons.

In particular, hollow casing 12 has a substantially box-like shape and, in the embodiment shown, it comprises a plurality of sheet metal pieces, which are assembled with one another as described more in detail below. In particular, the sheet metal pieces are coated with a plurality of armor panels.

Figure 1:
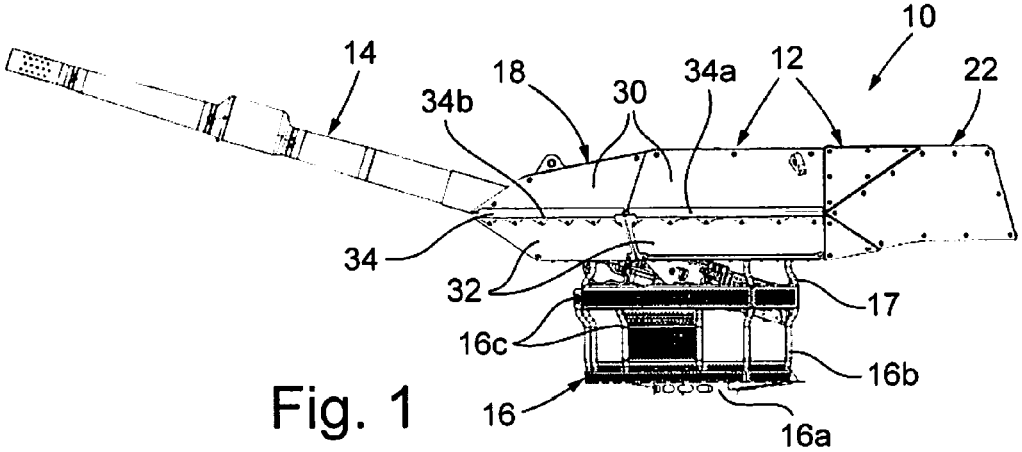
FIGS. 1 to 3 are bidimensional views, in particular a lateral elevation view, a front elevation view, and a plan view from above, respectively, of a turret for vehicles manufactured according to an explanatory embodiment of the present invention.
Figure 2:
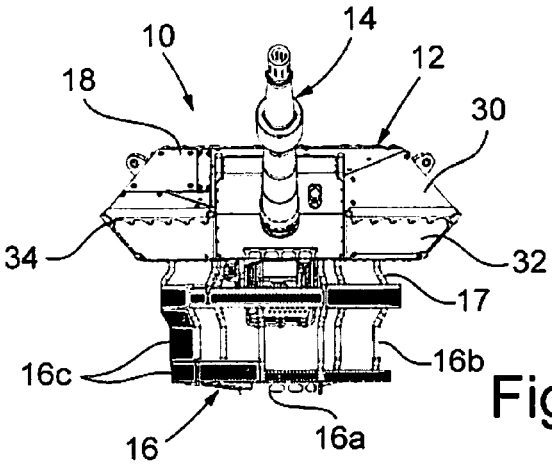
Figure 3:
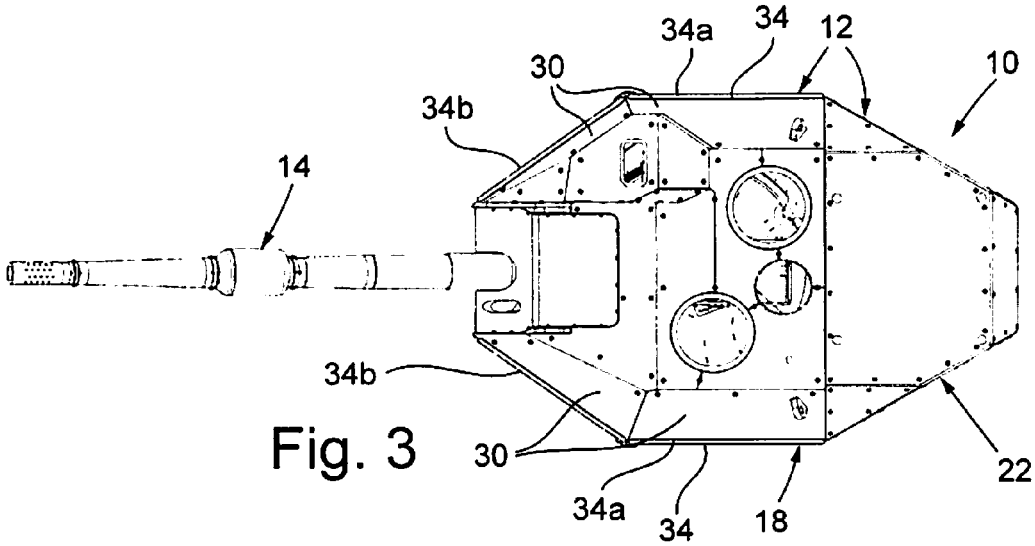

Furthermore, turret 10 comprises a basket 16, only partially visible in FIGS. 1 and 2, which extends through a bottom opening (not numbered) provided on the lower side of hollow casing 12 and is adapted to house the crew of the vehicle on which the turret is mounted.

In particular, turret 10 is fitted to the fighting vehicle in correspondence to the bottom of casing 12, typically by interposing a rotation support (e.g. bearings) between the structure of the vehicle and the bottom of casing 12.

In the embodiment shown, basket 16 comprises a base 16*a* and a plurality of uprights 16*b*, which preferably have a tubular shape and join the base to hollow casing 12. In particular, ballistic grids or plates 16*c* are transversely mounted between segments of the uprights 16*b* and are adapted to provide a protection for the compartment defined by basket 16.

Optionally, the uprights 16*b*, by bending or curving outwards, form a cove 17, which is arranged close to their top, so as to the increase the volume enclosed in basket 16 close to hollow casing 12. In this way, one can advantageously increase the usable space in the region at the boundary between the inside of hollow body 12 and casing 16, which typically is a critical area, since it is suited to house the seats (not visible) on which the operators making up the crew of the turret seat.

Figure 4:
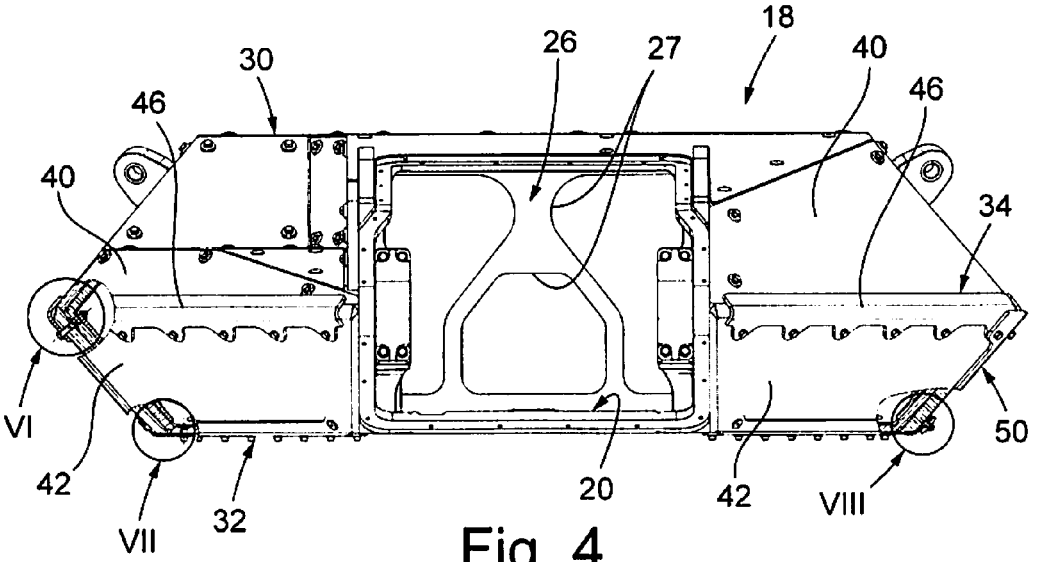
FIGS. 4 and 5 are bidimensional views, in particular a front elevation view and a lateral elevation view, respectively, of a front portion or shell of the turret shown in the previous figures.
Figure 5:
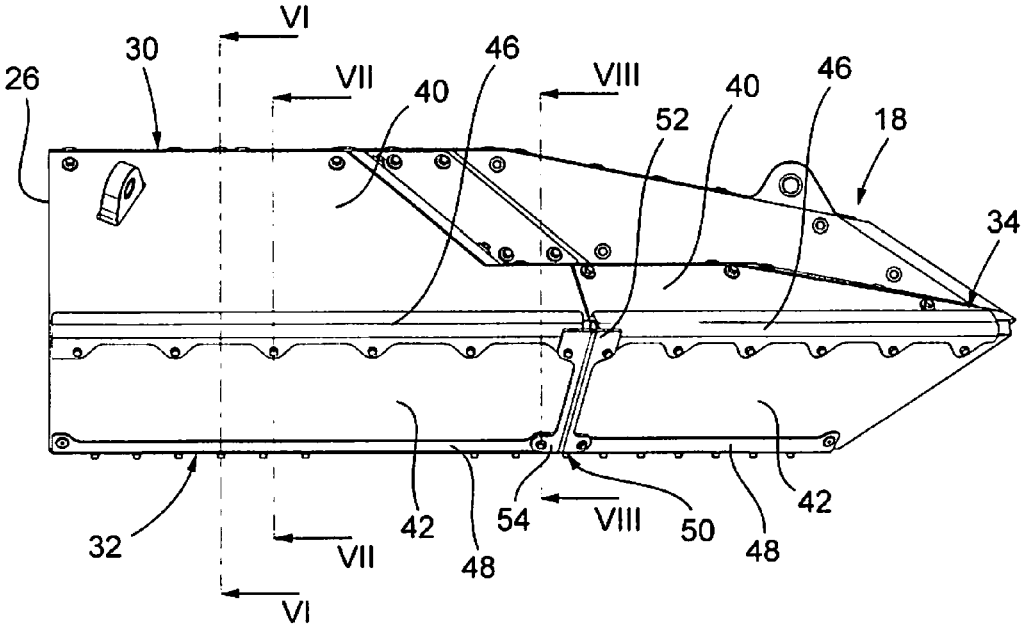

Hollow casing 12 comprises:

- a front portion or shell 18, on which firearm 14 is mounted and which defines a front cavity 20 (see FIG. 4); and
- a rear portion or tail 22, which houses at least one between a projectile magazine and a (motor-driven or manual) mechanism to load the projectiles (not shown) into the breech of said firearm 14 and which defines a rear cavity 24.

Front portion or shell 18 and rear portion or tail 22 are distinct from one another and are mutually mechanically assembled so that aforesaid cavities 20, 24 at least partially communicate with one another.

The presence of a front portion or shell 18 and of a rear portion or tail 22, which are separate from one another and subsequently assembled, has different advantages. For example, an advantage lies on the fact that the manufacturing processes of casing 12 can be separated, so that front portion or shell 18 is processed in a separate and independent manner relative to rear portion or tail 22. In particular, this allows operators to use smaller machines for the processing of the two portions 18, compared to the machine that would otherwise be necessary for a casing substantially consisting of a one-piece shell, for example manufactured by welding the sheet metal pieces making it up. Furthermore, the assembly and the preparation of front portion or shell 18 (with the firearm) and of rear portion or tail 22 (with at least one between the projectile magazine and the projectile loading mechanism) can take place in parallel, in order to then join the portions at the end of the relative assembling processes, thus remarkably reducing the overall manufacturing time.

The fact that, once assembled, cavities 20, 24 communicate with one another allows the projectiles stored in the magazine and/or introduced into the loading mechanism arranged in rear portion or tail 22 to be transferred to the breech of firearm 14 arranged in front portion or shell 18, preferably with the control and aid of the operators of the crew accommodated in basket 16.

Preferably, front portion or shell 18 and rear portion or tail 22 are mounted in a mutually removable manner, for example they can be connected to a plurality of screws designed to be removed when the two portion 18, 22 have to be disassembled. For example, this circumstance can be due to the need for maintenance or replacement of one of the two portions 18, 22. The possibility to disassemble the portions 18, 22 makes it easier for them to be moved and more quickly repaired or replaced, since they are separate from one another.

In the embodiment show, front portion or shell 18 and rear portion or tail 22 have a rear face 26 and a front face 28, respectively, which substantially match one another, are mutually juxtaposed and abutting, and are mechanically coupled to one another. Preferably, this coupling takes place by means of a removable connection between faces 26, 28 (for example, by means of screws that can be removed in case of need).

Preferably, rear face 26 and front face 28 are substantially flat and, in particular, are arranged on a substantially vertical plane.

In particular, rear face 26 and front face 28 have at least one rear window 27 and one front window 29, respectively, which match one another and are suited to overlap one another.

In the embodiment shown, front portion or shell 18 has the bottom opening and basket 16 is fitted thereto.

Furthermore, the bottom of front portion or shell 18 is suited to be mounted so as to rotate on top of the fixed or mobile structure on which turret 10 is suited to be installed, in this case a fighting vehicle. In particular, the assembly is performed by interposing a suitable rotation support between the structure and the bottom of the front portion or shell 18 (around the region in which basket 16 is mounted), for example bearings.

Preferably, casing 12 has an upper half-shell 30 at least partially widening towards the bottom of said casing 12 (hence, tapered towards the top), and a lower half-shell 32 at least partially widening towards the top of casing 12 (hence, tapered towards the bottom). Upper half-shell 30 and lower half-shell 32 meeting, widening, in at least one edge border 34 of casing 12. Thanks to these features, upper half-shell 30 and lower half-shell 32 obtained in this way have, on the one hand, a scarce radar perceivability (so-called "stealth effect") and, on the other hand, the ballistic ability of bouncing incident projectiles towards the outside.

Preferably, the aforesaid half-shells 30, 32 define, by widening and meeting, at least one lateral edge border 34*a*, which is laterally arranged on casing 12, in particular on front portion or shell 18. In the embodiment shown, half-shells 30, 32 define a pair of lateral edge borders 34*a*, which are arranged on opposite sides of the casing, in particular on front portion or shell 18. For example, this couple of lateral edge borders 34*a* are substantially parallel to one another.

Preferably, the aforesaid half-shells 30, 32 define, by widening, at least one front edge border 34*b*, which is frontally arranged on casing 12, in particular on front portion or shell 18. In the embodiment shown, half-shells 30, 32 define a pair of front edge borders 34*b*, in particular on front portion or shell 18. For example, these front edge borders 34*b* frontally converge relative to casing 12, in particular relative to front portion or shell 18.

In particular edge borders 34 are arranged in correspondence to at least part of the perimeter of casing 12 (and, in particular, of front portion or shell 18) and, more in particular, in correspondence to the lateral profiles or lateral sides that join in a part of the front profile that is frontally tapered to house firearm 14.

As a person skilled in the art clearly understands, even though in the embodiment shown edge borders 34 are carried only by front part or shell 18, in possible variants of the invention they can also be applied to rear portion or tail 22.

Figure 6:
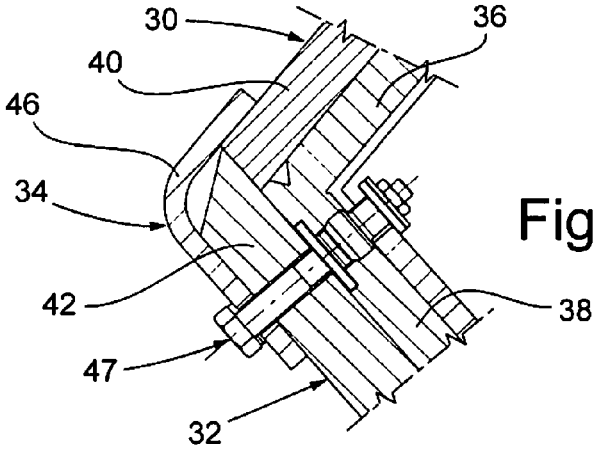
FIGS. 6 to 8 are enlarged views, in partial cutaway drawings, of manufacturing details shown in FIG. 4 and highlighted therein with the closed curves VI, VII and VIII.
Figure 7:
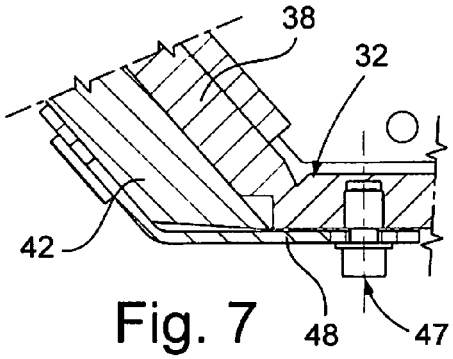
Figure 8:
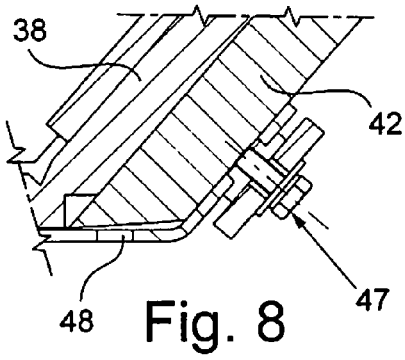
Figure 9:
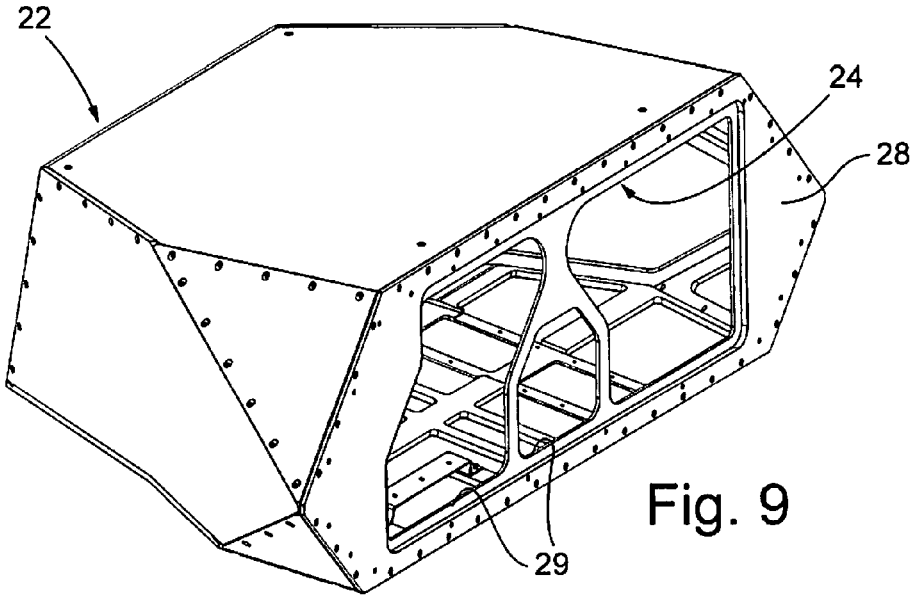
FIG. 9 is a perspective view of a rear portion or tail of the turret shown in FIGS. 1 to 3.
Figure 10:
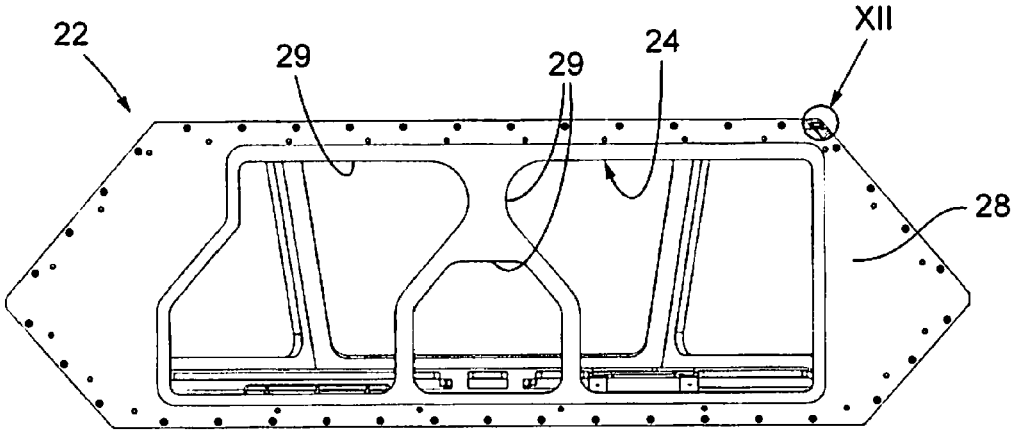
FIGS. 10 and 11 are bidimensional views, in particular a front elevation view and a lateral elevation view, respectively, of the rear portion or tail shown in FIG. 9.
Figure 11:
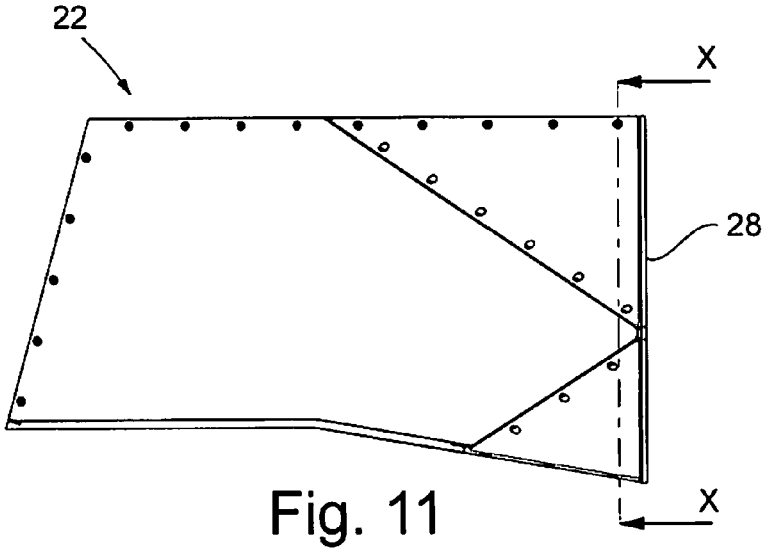

With reference, in particular, to the FIGS. 6 to 8, the structure of edge borders 34 can also permit an improved fitting of an armor onto casing 12, in particular in correspondence to half-shells 30, 32.

As shown in the FIGS. 6 to 8, upper half-shell 30 and lower half-shell 32 are joined in correspondence to each edge border 34 by means of at least one upper inclined sheet metal piece 36 and one lower inclined sheet metal piece 38, respectively. For example, upper inclined sheet metal piece 36 and lower inclined sheet metal piece 38 can be welded to one another in correspondence to edge border 34.

In particular, in each region where an edge border 34 is provided, upper half-shell 30 and lower half-shell 32 have, on the outside, an upper armored panel 40 and a lower armored panel 42, in the embodiment shown arranged above inclined sheet metal pieces 36, 38. Panels 40, 42 are adjacent and peripherally in contact with one another, in particular in correspondence to edge border 34.

In the embodiment shown, in correspondence to each edge border 34, casing 12 comprises, furthermore, a fixing element 46, which matches and covers the area where panels 40, 42 are adjacent to one another. More in detail, fixing element 46 is oblong (for example, extends along the entire length of adjacent panels 40, 42 in correspondence to edge border 34) and has a concavity facing the area where panels 40, 42 are adjacent to and in contact with one another. In particular, fixing element 46 has a substantially V-shaped section.

Preferably, fixing element 46 is constrained to said casing 12 (lower half-shell 30) by means of through members 47, for example by means of a plurality of screws, which extend through lower panel 42 and, in particular, are aligned under edge border 34. This constraint is able to allow fixing element 46 to ensure the stability of the support of adjacent panels 40, 42. In fact, in the embodiment shown, the invention avoids, for this reason, a coupling of fixing element 46 to casing 12 (upper half-shell 32) by means of members extending through upper panel 40.

This situation has the significant advantage of offering the possibility to reduce the number of points in which panels 40, 42 are perforated, since, in this way, weakening areas of the panels are created in an undesired manner. Furthermore, the preferred decision of perforating the sole lower panel 42 for the fitting of the fixing element is advantageous due to the fact that the potentially weakened areas of the armor of casing 12 are arranged in a position that is difficult to reach for a projectile that is aimed at turret 10.

In the embodiment shown, through members 47 extend through lower panel 42 and lower sheet metal piece 38, which are arranged one on top of the other, to obtain the fitting of fixing element 46.

Preferably, base fixing elements 48 are also provided, which are similar to fixing elements 46 described above with reference to the area where edge border 34 is provided. Base fixing elements 48 are interposed between lower armored panel 42 and the bottom of lower half-shell 32. In the case shown in FIG. 7, through members 47, which allow each base fixing element 48 to be coupled to casing 12, extend through the bottom of lower half-shell 32, in particular without passing through lower armored plate 42. On the contrary, in the case shown in FIG. 8, through members 47 extend through lower armored plate 42, in a transverse direction.

Furthermore, fixing uprights 50 are optionally provided, in particular of the plate-like type, each one of them being suited to connect fixing element 46 to base fixing element 48 associated with the same lower panel 42. Preferably, each one of them is also suited to connect pairs of mutually adjacent fixing elements 46 and/or pairs of mutually adjacent base fixing elements 48, thus also constraining to one another, in particular, the adjacent lower panels 42.

In this way, in particular, fixing uprights 50 overlap the areas in which lower panels 42 are adjacent to one another, so as to avoid empty spaces in the armor built by panels 40, 42.

Preferably, each fixing upright 50, at the same axial end 52, connects to adjacent fixing elements 46, for example, by being passed through by the same through members that extend through fixing elements 46 and lower armored panel 42. In this way, in order to fit fixing uprights 50, operators do not need to drill further holes through lower armored panel 42, besides the ones that are already needed for the installation of fixing elements 46. The same also applies to opposite axial end 54 of fixing upright 50, with the difference that it connects base fixing elements 48 that are adjacent to one another.

In the embodiment shown, each fixing element 50 has ends 52, 54, that are wider then the rest of the upright, in particular creating the shape of a "dog bone".

Figure 12:
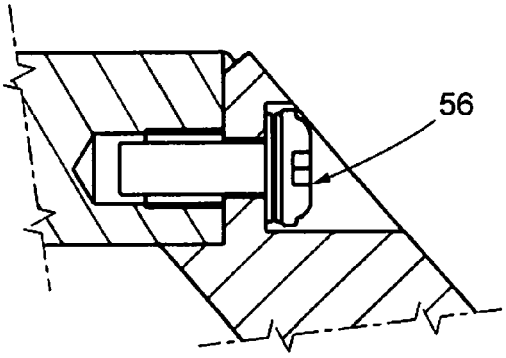
FIG. 12 is an enlarged view, in partial cutaway drawing, of manufacturing details shown in FIG. 10 and highlighted therein with the closed curve XII.

FIG. 12 shows a detail of rear portion or tail 22 of casing 12. Preferably, rear portion or tail 22 is manufactured with a plurality of sheet metal pieces, which are cold-assembled with one another, for example screwed to one another, in particular without performing hot-assembling procedures, such as welding procedures. The mechanical connection between adjacent areas of the sheet metal pieces fixed together is performed by means of ballistic interlocking means, generically indicated with 56, which are known for casings manufactured by means of welding. This reduces manufacturing costs and times and makes repairs easier to be performed.

In the embodiment shown, front portion or shell 18 is manufactured by welding a plurality of sheet metal pieces 36, 38, on which armored panels (40, 42) are mechanically heat-free mounted, in particular by means of the use of screws (preferably, in accordance with the solution described above).

Naturally, the principle of the present invention being set forth, the embodiments and the implementation details can be widely changed with respect to what described above and shown in the drawings as a mere way of non-limiting example, without in this way going beyond the scope of protection provided by the accompanying claims.

The invention claimed is:

1. A turret for a fighting vehicle; said turret comprising a hollow casing provided with a firearm, said casing comprising:

an upper half-shell at least partially widening towards a bottom of said casing, and a lower half-shell at least partially widening towards a top of said casing, said upper half-shell and said lower half-shell meeting, and widening, in at least one edge border of the casing;

in an area wherein said at least one edge border is arranged, said upper half-shell and said lower half-shell have, on an outside, an upper armored panel and a lower armored panel respectively; said upper armored panel and said lower armored panel being adjacent and peripherally in contact with one another;

a fixing element, located in the area wherein said at least one edge border is arranged, which matches and covers an area wherein said upper armored panel and said lower armored panel are adjacent to one another, the fixing element being constrained to said casing by through organs which extend through said lower panel;

at least one base fixing element, which is interposed between said lower armored panel and the bottom of the lower half-shell and matches the area where said lower armored panel and said bottom of the lower half-shell are adjacent to one another so as to cover the area where said lower armored panel and said bottom of the lower half-shell are adjacent to one another;

at least one fixing upright which overlaps and connects the fixing element to the base fixing element associated with said lower panel.

2. A turret according to claim 1, wherein said half-shells define, by meeting and widening, at least one lateral edge border, which is arranged on the side of said casing (12).

3. A turret according to claim 1, wherein said half-shells define, by meeting and widening, at least one front edge border which is arranged on the front of said casing.

4. A turret according to claim 1, wherein said at least one fixing upright overlaps and connects a pair of mutually adjacent fixing elements and/or a pair of mutually adjacent base fixing elements.

* * * * *